US006508071B2

(12) United States Patent
Ota et al.

(10) Patent No.: US 6,508,071 B2
(45) Date of Patent: Jan. 21, 2003

(54) AIR CONDITIONER AND DISPLACEMENT CONTROL VALVE FOR VARIABLE DISPLACEMENT COMPRESSOR

(75) Inventors: Masaki Ota, Kariya (JP); Masahiro Kawaguchi, Kariya (JP); Ken Suitou, Kariya (JP); Taku Adaniya, Kariya (JP); Hirotaka Kurakake, Kariya (JP); Hiroyuki Yoshida, Kariya (JP); Kazuya Kimura, Kariya (JP); Ryo Matsubara, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 22 days.

(21) Appl. No.: 09/875,739

(22) Filed: Jun. 6, 2001

(65) Prior Publication Data

US 2001/0052236 A1 Dec. 20, 2001

(30) Foreign Application Priority Data

Jun. 8, 2000 (JP) ..... 2000-171738

(51) Int. Cl.[7] ..... F25B 1/00; G01F 1/22

(52) U.S. Cl. ..... 62/228.3; 73/861.53; 417/222.2

(58) Field of Search ..... 62/228.3, 228.5; 417/222.2; 73/861.53

(56) References Cited

U.S. PATENT DOCUMENTS 4,083,245 A * 4/1978 Osborn ..... 73/861.53 X
6,102,668 A * 8/2000 Kawaguchi et al. ..... 417/222.2
6,385,979 B2 * 5/2002 Ota et al. ..... 62/228.3 X

* cited by examiner

*Primary Examiner*—William Wayner
(74) *Attorney, Agent, or Firm*—Morgan & Finnegan, LLP

(57) ABSTRACT

A control valve is located in a variable displacement compressor incorporated in a refrigerant circuit. The control valve controls the displacement of the compressor in accordance with a pressure difference between a first pressure monitoring point and a second pressure monitoring point, which are located in the refrigerant circuit, such that the pressure difference seeks a predetermined target value. An adjusting valve, which is a variable throttle valve, is located in a section of the refrigerant circuit between the first and second pressure monitoring points. The adjusting valve adjusts the restriction amount of the refrigerant in relation to the refrigerant flow in the refrigerant circuit. The compressor displacement is thus optimally controlled.

21 Claims, 9 Drawing Sheets

AIR CONDITIONER AND DISPLACEMENT CONTROL VALVE FOR VARIABLE DISPLACEMENT COMPRESSOR

BACKGROUND OF THE INVENTION

The present invention relates to vehicle air conditioners and displacement control valves for controlling displacement of variable displacement compressors used in the air conditioners.

A typical refrigerant circuit in a vehicle air-conditioner includes a condenser, an expansion valve, an evaporator and a compressor. The compressor is driven by a vehicle engine. The compressor draws refrigerant gas from the evaporator, then, compresses the gas and discharges the compressed gas to the condenser. The evaporator performs heat exchange between the refrigerant in the refrigerant circuit and the air in the passenger compartment. The heat of air at the evaporator is transmitted to the refrigerant flowing through the evaporator in accordance with the thermal load or the cooling load. Therefore, the pressure of refrigerant gas at the outlet of or the downstream portion of the evaporator represents the cooling load.

Variable displacement compressors are widely used in vehicles. Such compressors include a displacement control valve that operates to maintain the pressure at the outlet of the evaporator, or the suction pressure, at a predetermined target level (target suction pressure). The control valve feedback controls the displacement of the compressor by referring to the suction pressure such that the flow rate of refrigerant in the refrigerant circuit corresponds to the cooling load.

The displacement control valve includes a pressure sensitive member that moves the valve body in accordance with the suction pressure. The pressure in the crank chamber is adjusted in relation to the position of the valve body. The inclination angle of a swash plate located in the compressor is altered depending on the pressure in the crank chamber. This varies the displacement of the compressor.

A certain type of displacement control valve alters the target suction pressure through an external electric control procedure. The control valve includes an electromagnetic actuator such as a solenoid. When an electric current is externally supplied to the electromagnetic actuator, the actuator urges the pressure sensitive member with the force varied in relation to a value of the electric current. The value of the electric current reflects the target suction pressure.

However, the actual suction pressure reaches the target value, which is changed through the electric control procedure, only after a certain delay. More specifically, the thermal load that acts on the evaporator affects the suction pressure, thus causing the delay. Accordingly, although the target suction pressure is adjusted accurately through the electric control procedure, the displacement of the compressor cannot be varied quickly or smoothly.

BRIEF SUMMARY OF THE INVENTION

It is an objective of the present invention to provide an air conditioner and a displacement control valve of a variable displacement compressor that vary compressor displacement quickly and smoothly.

To achieve the above objective, the present invention provides an air conditioning apparatus provided with a refrigerant circuit including a variable displacement compressor. The air conditioning apparatus includes a displacement control mechanism, which controls the displacement of the compressor in relation to a pressure difference between a first pressure monitoring point and a second pressure monitoring point in the refrigerant circuit such that the pressure difference seeks a predetermined target value. The second pressure monitoring point is located downstream of the first pressure monitoring point. The displacement control mechanism has an altering device for altering the target value. A first pressure introducing passage introduces the pressure at the first pressure monitoring point to the displacement control mechanism. The first pressure monitoring point and the first pressure introducing passage form a high pressure zone. A second pressure introducing passage introduces the pressure at the second pressure monitoring point to the displacement control mechanism. The second pressure monitoring point and the second pressure introducing passage form a low pressure zone. An adjusting line connects, the high pressure zone to the low pressure zone. An adjusting valve adjusts the opening size of the adjusting line.

The present invention also provides a displacement control valve for controlling the displacement of a variable displacement compressor incorporated in a refrigerant circuit of an air conditioning apparatus. The control valve includes a valve housing, a valve body, which is accommodated in the valve housing, a pressure sensitive chamber, which is formed in the valve housing, and a pressure sensitive member, which divides the pressure sensitive chamber to a first pressure chamber and a second pressure chamber. The pressure at a first pressure monitoring point in the refrigerant circuit is introduced to the first pressure chamber. The pressure at a second pressure monitoring point in the refrigerant circuit is introduced to the second pressure chamber. The pressure sensitive member moves the valve body in accordance with the pressure difference between the first pressure chamber and the second pressure chamber, thereby controlling the displacement of the compressor such that the pressure difference between the first and second pressure monitoring points seeks a predetermined target value. The control valve further includes an altering device for altering the target value. The altering device urges the valve body with a force corresponding to the target value. An adjusting line is formed in the pressure sensitive member to connect the first pressure chamber to the second pressure chamber. An adjusting valve adjusts the opening size of the adjusting line.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
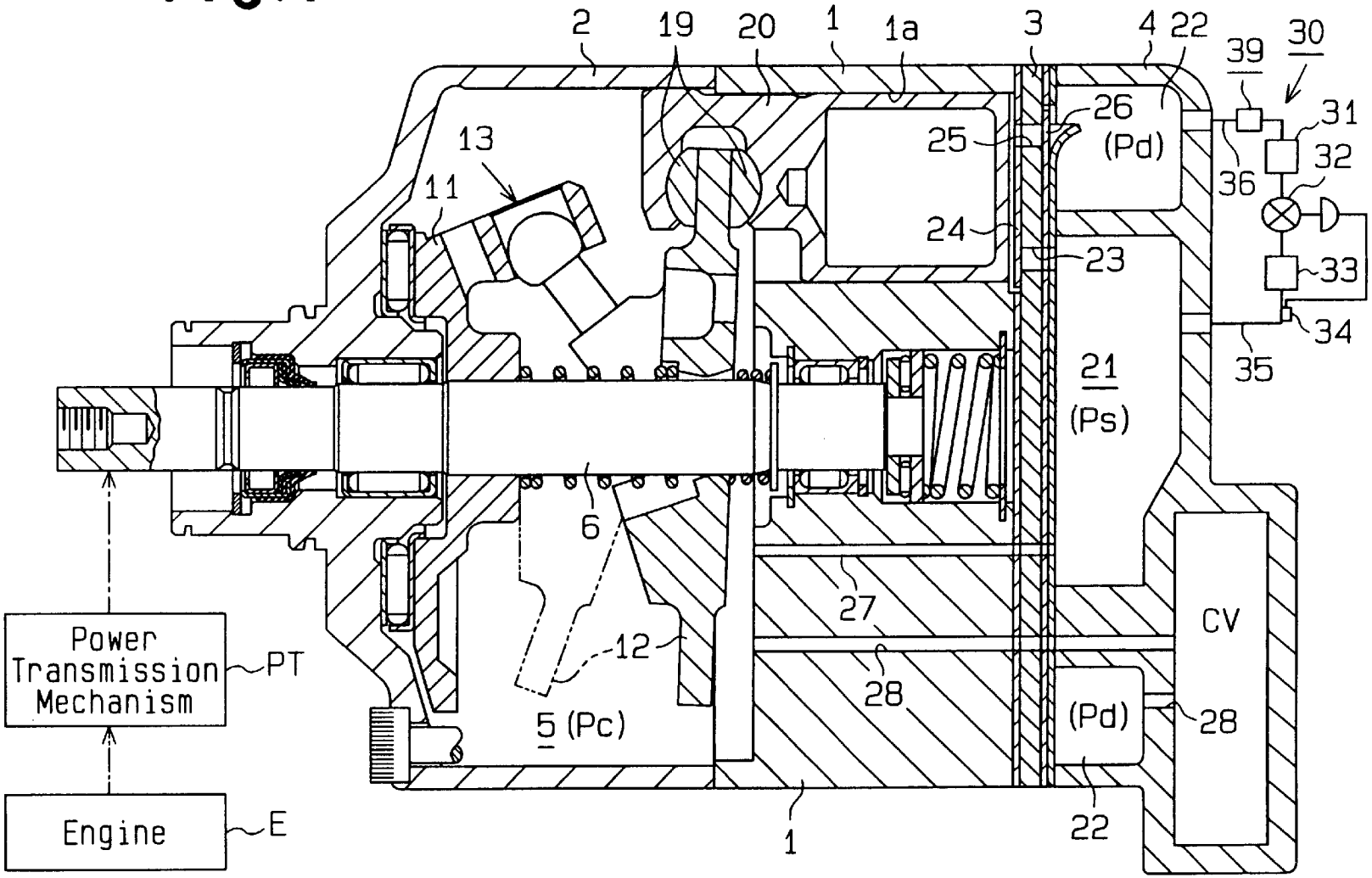
FIG. 1 is a cross-sectional view showing a swash plate type variable displacement compressor of a first embodiment according to the present invention.

First to fourth embodiments of the present invention will now be described. In describing the second and fourth embodiments, only the differences from the first embodiment will be discussed. Same or like reference numerals are given to parts in the second and fourth embodiments that are the same as or like corresponding parts of the first embodiment.

First Embodiment

The compressor shown in FIG. 1 includes a cylinder block 1, a front housing member 2 connected to the front end of the cylinder block 1, and a rear housing member 4 connected to the rear end of the cylinder block 1. A valve plate 3 is located between the rear housing member 4 and the cylinder block 1.

A crank chamber 5 is defined between the cylinder block 1 and the front housing member 2. A drive shaft 6 is supported in the crank chamber 5 by bearings. A lug plate 11 is fixed to the drive shaft 6 in the crank chamber 5 to rotate integrally with the drive shaft 6.

The front end of the drive shaft 6 is connected to an external drive source, which is an engine E in this embodiment, through a power transmission mechanism PT. In this embodiment, the power transmission mechanism PT is a clutchless mechanism that includes, for example, a belt and a pulley. Alternatively, the mechanism PT may be a clutch mechanism (for example, an electromagnetic clutch) that selectively transmits power in accordance with the value of an externally supplied current.

A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The swash plate 12 is coupled to the lug plate 11 and the drive shaft 6 through the hinge mechanism 13. The swash plate 12 rotates synchronously with the lug plate 11 and the drive shaft 6.

Cylinder bores 1*a* (only one is shown in FIG. 1) are formed in the cylinder block 1 at constant angular intervals around the drive shaft 6. Each cylinder bore 1*a* accommodates a single headed piston 20 such that the piston 20 can reciprocate in the bore 1*a*. A compression chamber, the volume of which varies in accordance with the reciprocation of the piston 20, is defined in each bore 1*a*. The front end of each piston 20 is connected to the periphery of the swash plate 12 through a pair of shoes 19. The rotation of the swash plate 12 is converted into reciprocation of the pistons 20, and the strokes of the pistons 20 depend on the inclination angle of the swash plate 12.

The valve plate 3 and the rear housing member 4 define, between them, a suction chamber 21 and a discharge chamber 22, which surrounds the suction chamber 21. The valve plate 3 forms, for each cylinder bore 1*a*, a suction port 23, a suction valve flap 24 for opening and closing the suction port 23, a discharge port 25, and a discharge valve flap 26 for opening and closing the discharge port 25. The suction chamber 21 communicates with each cylinder bore 1*a* through the corresponding suction port 23, and each cylinder bore 1*a* communicates with the discharge chamber 22 through the corresponding discharge port 25.

When each piston 20 moves from its top dead center position to its bottom dead center position, the refrigerant gas in the suction chamber 21 flows into the cylinder bore 1*a* through the corresponding suction port 23 and the corresponding suction valve flap 24. When the piston 20 moves from its bottom dead center position toward its top dead center position, the refrigerant gas in the cylinder bore 1*a* is compressed to a predetermined pressure, and it forces the corresponding discharge valve flap 26 to open. The refrigerant gas is then discharged through the corresponding discharge port 25 and the corresponding discharge valve flap 26 into the discharge chamber 22.

The inclination angle of the swash plate 12 (the angle between the swash plate 12 and a plane perpendicular to the axis of the drive shaft 6) is determined on the basis of various moments such as the moment of rotation caused by the centrifugal force upon rotation of the swash plate, the moment of inertia based on the reciprocation of the pistons 20, and a moment due to the gas pressure. The moment due to the gas pressure is based on the relationship between the pressure in the cylinder bores 1*a* and the crank pressure Pc. The moment due to the gas pressure increases or decreases the inclination angle of the swash plate 12 in accordance with the crank pressure Pc.

In this embodiment, the moment due to the gas pressure is changed by controlling the crank pressure Pc with a displacement control valve CV. The inclination angle of the swash plate 12 can be changed to an arbitrary angle between the minimum inclination angle (shown by a solid line in FIG. 1) and the maximum inclination angle (shown by a broken line in FIG. 1).

Figure 2:
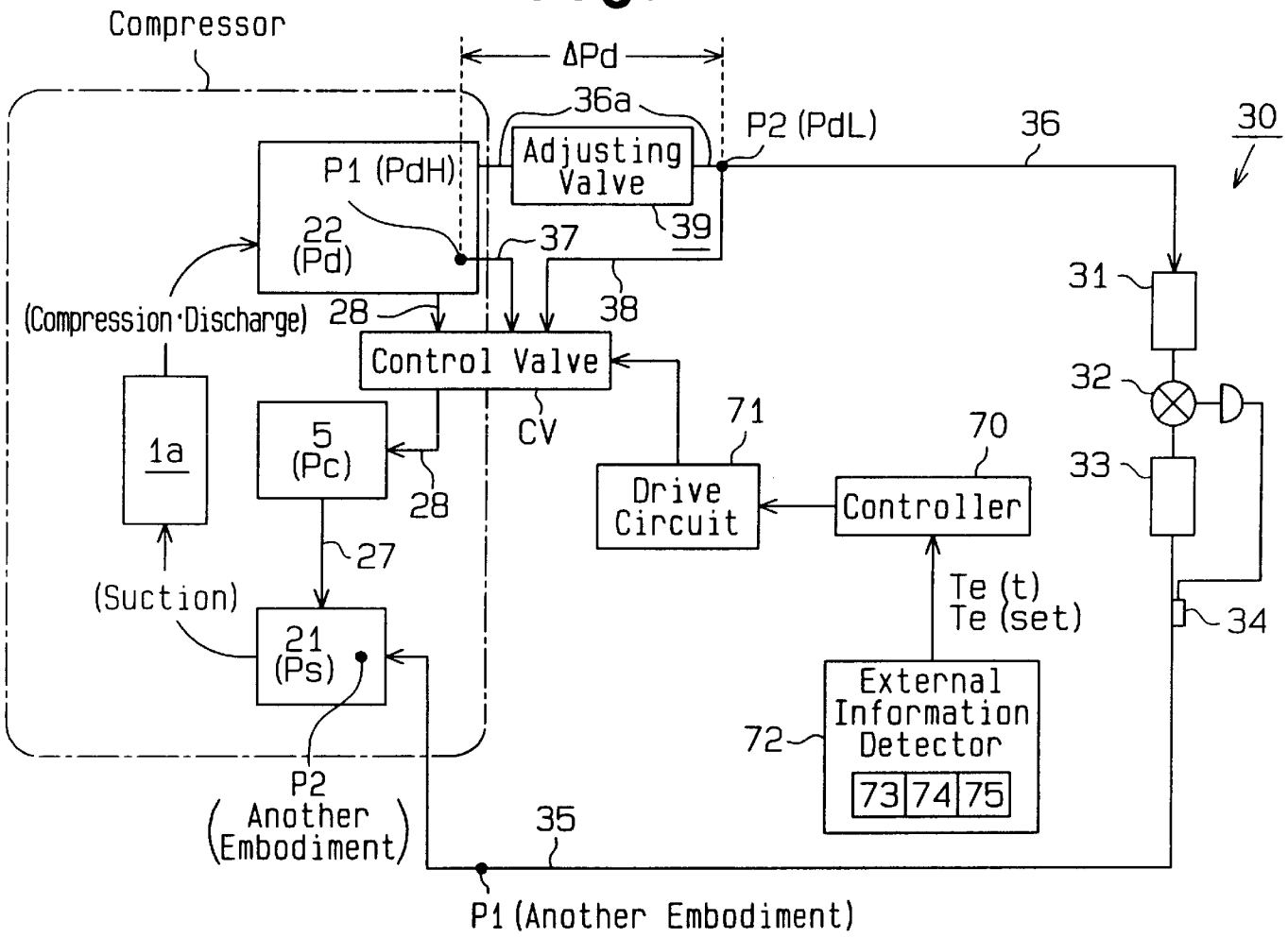
FIG. 2 is a circuit diagram schematically showing a refrigerant circuit.

As shown in FIGS. 1 and 2, a control mechanism for controlling the crank pressure Pc includes a bleed passage 27, a supply passage 28 and a displacement control valve CV. The bleed passage 27 connects the suction chamber 21, which is a suction pressure (Ps) zone, and the crank chamber 5. The supply passage 28 connects the discharge chamber 22, which is a discharge pressure (Pd) zone, and the crank chamber 5. The displacement control valve CV is provided midway along the supply passage 28.

The displacement control valve CV changes the opening size of the supply passage 28 to control the flow rate of refrigerant gas flowing from the discharge chamber 22 to the crank chamber 5. The pressure in the crank chamber 5 is changed in accordance with the relation between the flow rate of refrigerant gas flowing from the discharge chamber 22 into the crank chamber 5 and the flow rate of refrigerant gas flowing out from the crank chamber 5 through the bleed passage 27 into the suction chamber 21. In accordance with changes in the crank pressure Pc, the difference between the crank pressure Pc and the pressure in the cylinder bores 1*a* varies to change the inclination angle of the swash plate 12. As a result, the stroke of the pistons 20 is changed to control the displacement.

As shown in FIGS. 1 and 2, the refrigerant circuit of the vehicle air conditioner includes the compressor and an external refrigerant circuit 30. The external refrigerant circuit 30 includes, for example, a condenser 31, a decompression device, which is an expansion valve 32 in this embodiment, and an evaporator 33. The opening of the expansion valve 32 is feedback-controlled on the basis of the temperature detected by a temperature sensing tube 34 provided near the outlet of the evaporator 33. The expansion valve 32 supplies a quantity Q of refrigerant corresponding to the thermal load to control the flow rate.

In the downstream part of the external refrigerant circuit 30, a low pressure passage, which is a flow pipe 35 in this embodiment, is provided to connect the outlet of the evaporator 33 with the suction chamber 21. In the upstream part of the external refrigerant circuit 30, a high pressure passage, which is a flow pipe 36 in this embodiment, is provided to connect the discharge chamber 22 of the compressor with the inlet of the condenser 31. The compressor draws refrigerant gas from the downstream side of the external refrigerant circuit 30, compresses the gas, and then discharges the compressed gas to the discharge chamber 22, which is connected to the upstream side of the external refrigerant circuit 30.

The higher the flow rate Q of the refrigerant flowing in the refrigerant circuit is, the greater the pressure loss per unit length of the circuit or piping is. More specifically, the pressure loss between two pressure monitoring points P1, P2 in the refrigerant circuit correlates with the flow rate of the refrigerant circuit. Detected difference in pressure (pressure difference ΔPd) between the pressure monitoring points P1 and P2 represents the flow rate of refrigerant in the refrigerant circuit.

In this embodiment, an upstream, or first, pressure monitoring point P1 is located in the discharge chamber 22, which is the most upstream part of the flow pipe 36. A downstream, or second, pressure monitoring point P2 is set midway along the flow pipe 36 at a position separated from the first pressure monitoring point P1 by a predetermined distance. The gas pressure PdH at the first pressure monitoring point P1 and the gas pressure PdL at the second pressure monitoring point P2 are applied to the displacement control valve CV through first and second pressure introduction passages 37 and 38, respectively.

Figure 4A:
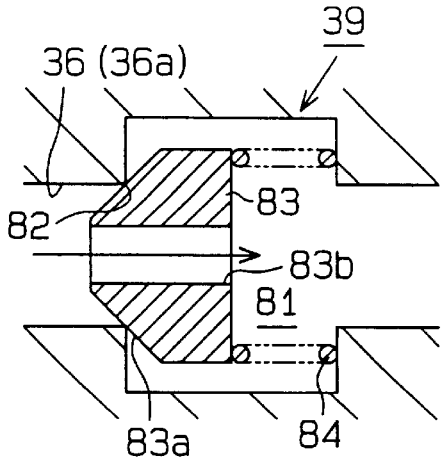
FIGS. 4(*a*) and 4(*b*) are enlarged cross-sectional views showing a pressure difference adjusting valve of FIG. 1.
Figure 4B:
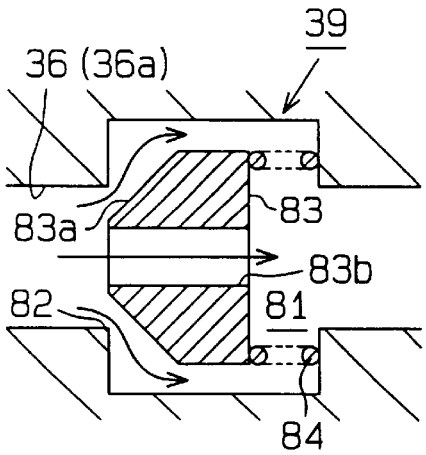

As shown in FIGS. 2, 4(*a*) and 4(*b*), a pressure difference adjusting valve 39 is located in the flow pipe 36 at a position between the pressure monitoring points P1, P2. A section of the flow pipe 36 between the pressure monitoring points P1, P2 functions as a pressure difference adjusting line 36*a*. The pressure difference adjusting valve 39 is a variable restrictor or a variable throttle valve that reduces the communication area of the flow pipe 36. This structure increases the pressure difference ΔPd (=PdH−PdL) between the pressure monitoring points P1, P2. That is, the pressure difference adjusting valve 39 allows the pressure monitoring points P1, P2 to be separated from each other by a relatively small interval while allowing the second pressure monitoring point P2 to be located relatively close to the compressor (the discharge chamber 22). Accordingly, the second pressure introduction passage 38, which connects the second pressure monitoring point P2 to the control valve CV of the compressor, is shortened.

The pressure difference adjusting valve 39 will hereafter be described. As shown in FIGS. 4(*a*) and 4(*b*), a valve chamber 81 is formed in the pressure difference adjusting line 36*a*. A step is formed between the inner wall of the valve chamber 81 and the inner wall of an upstream section of the pressure difference adjusting line 36*a*. The step functions as a valve seat 82. A valve body 83 is accommodated in the valve chamber 81 and is moved selectively to contact and be separated from the valve seat 82. A cross-sectional shape of the valve body 83 perpendicular to the axis is circular. The valve body 83 includes a tapered shutter surface 83*a* that linearly contacts the valve seat 82 along an annular path. A restricting line 83*b* extends through the valve body 83 along its axis. The restricting line 83*b* thus constantly opens the pressure difference adjusting line 36*a*, regardless of the position of the valve body 83 in the valve chamber 81. An urging spring 84 is accommodated in the valve chamber 81 and urges the valve body 83 toward the valve seat 82.

A plurality of sources apply force to the valve body 83, thus determining the opening size of the valve body 83. The sources include the pressure acting on the upstream side of the valve body 83, the pressure acting on the downstream side of the valve body 83, and the urging spring 84. The valve body 83 moves in accordance with the difference between the pressure acting on the upstream side of the valve body 83 and the pressure acting on the downstream side of the valve body 83. This pressure difference varies in relation to the amount of the refrigerant flowing in the refrigerant circuit, or the refrigerant flow rate Q. The opening size of the valve body 83 is thus determined depending on the refrigerant flow rate Q.

Figure 5:
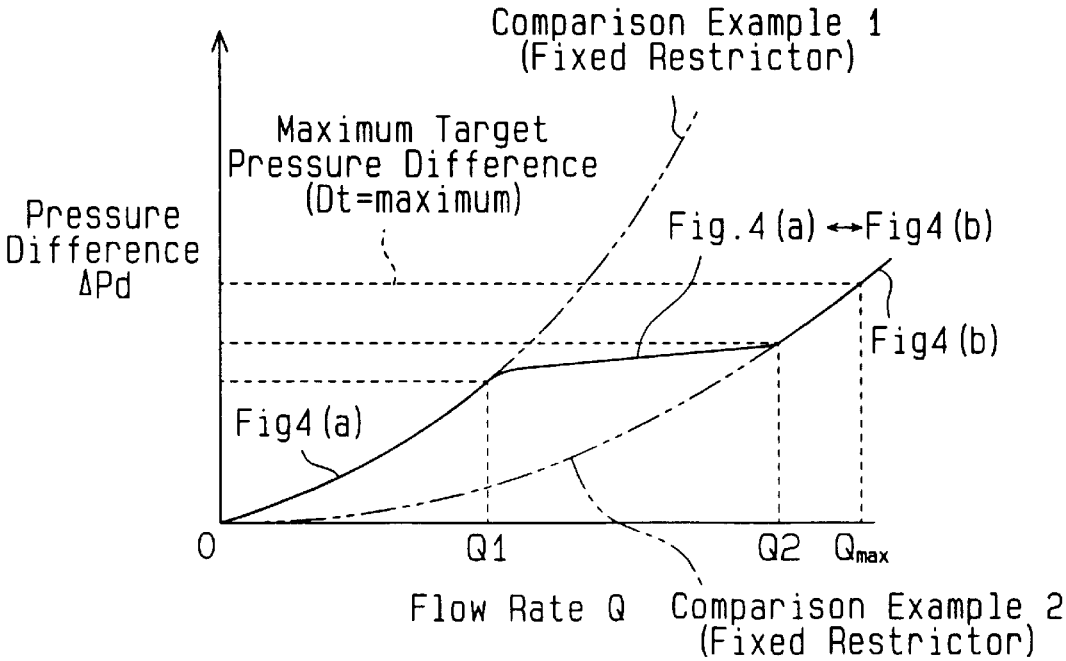
FIG. 5 is a graph representing the relationship between refrigerant flow and pressure difference between a pair of pressure monitoring points.

For example, if the refrigerant flow rate Q is in a relatively low range, which is less than a first predetermined value Q1, the pressure difference between the upstream side and the downstream side of the valve body 83 is relatively small (see FIG. 5). The force caused by this pressure difference that urges the valve body 83 to open the pressure difference adjusting line 36*a* thus becomes smaller than the force of the urging spring 84, which urges the valve body 83 to close the pressure difference adjusting line 36*a*. Accordingly, the valve body 83 contacts the valve seat 82, as shown in FIG. 4(*a*), thus maximizing the restriction amount of the refrigerant by the pressure difference adjusting valve 39. In other words, the pressure difference adjusting valve 39 minimizes the communication area of the pressure difference adjusting line 36*a* to a value corresponding to the cross-sectional area of the restricting line 83*b*. As described, as long as the refrigerant flow rate Q is varied in the relatively low range, the pressure difference adjusting valve 39 functions as a fixed restrictor that maintains the communication area of the pressure difference adjusting line 36*a* at a minimum value.

If the refrigerant flow rate Q is equal to or greater than the first predetermined value Q1, the force generated by the pressure difference between the upstream side and the downstream side of the valve body 83, which urges the valve body 83 to open the pressure difference adjusting line 36*a*, becomes greater than the force of the urging spring 84, which urges the valve body 83 to close the line 36*a*. Thus, as shown in FIG. 4(*b*), the valve body 83 is separated from the valve seat 82. Accordingly, the pressure difference adjusting valve 39 adjusts the communication area of the pressure difference adjusting line 36*a* to a total value of the cross-sectional area of the restricting line 83*b* and the communication area of a refrigerant passage formed between the shutter surface 83*a* of the valve body 83 and the valve seat 82.

As the refrigerant flow rate Q gradually increases from the first predetermined value Q1, the force generated by the pressure difference between the upstream side and the downstream side of the valve body 83, which urges the valve body 83 to open the pressure difference adjusting line 36*a*, is gradually increased. Meanwhile, the communication area of the refrigerant passage between the shutter surface 83*a* of the valve body 83 and the valve seat 82 is also gradually increased. This decreases the restriction amount of the refrigerant by the pressure difference adjusting valve 39.

If the refrigerant flow rate Q in the refrigerant circuit is in a relatively high range, which is equal to or greater than a second predetermined value Q2, the urging spring 84 is maximally compressed such that the distance by which the valve body 83 is separated from the valve seat 82 is maximized (see FIG. 5). Thus, as shown in FIG. 4(*b*), the communication area of the refrigerant passage between the shutter surface 83*a* of the valve body 83 and the valve seat 82 is also maximized. This minimizes the restriction amount of the refrigerant by the pressure difference adjusting valve 39. Accordingly, as long as the refrigerant flow rate Q is varied in the relatively high range, the pressure difference adjusting valve 39 functions as a fixed restrictor that maintains the communication area of the pressure difference adjusting line 36*a* as a maximum value.

If the refrigerant flow rate Q is in an intermediate range, which is between the first predetermined value Q1 and the second predetermined value Q2, the pressure difference adjusting valve 39 functions as a variable restrictor (variable throttle valve) that varies the restriction amount of the refrigerant in accordance with the refrigerant flow rate Q. The pressure difference adjusting valve 39 decreases the restriction amount of the refrigerant as the refrigerant flow rate Q increases. In contrast, the pressure difference adjusting valve 39 increases the restriction amount of the refrigerant as the refrigerant flow rate Q decreases. If the restriction amount of the refrigerant by the pressure difference adjusting valve 39 is reduced, the pressure ratio of the first pressure monitoring point P1 to the second pressure monitoring point P2 decreases. In contrast, if the restriction amount of the refrigerant by the pressure difference adjusting valve 39 is increased, the pressure ratio of the first pressure monitoring point P1 to the second pressure monitoring point P2 increases. In other words, as indicated by the solid line in FIG. 5, as long as the refrigerant flow rate Q is varied in the intermediate range, the pressure difference adjusting valve 39 varies the restriction amount of the refrigerant to suppress variation in the pressure difference ΔPd between the pressure monitoring points P1, P2 with respect to variation in the refrigerant flow rate Q.

As indicated by the solid line in FIG. 5, if the refrigerant flow rate Q is in the intermediate range, the pressure difference ΔPd between the pressure monitoring points P1, P2 is varied at a relatively low rate with respect to the variation in the refrigerant flow rate Q, as compared to when the refrigerant flow rate Q is in the relatively high or low range. The spring constant of the urging spring 84 and the rate at which the restriction amount of the refrigerant by the pressure difference adjusting valve 39 is varied relative to the refrigerant flow rate Q are selected such that the relationship between the refrigerant flow rate Q and the pressure difference ΔPd has the characteristics indicated by the solid line of FIG. 5. If the refrigerant flow rate Q is varied in the intermediate range, the pressure difference ΔPd is varied with a relatively low rate and in positive correlation with the refrigerant flow rate Q. Regardless of the refrigerant flow rate Q, each value of the pressure difference ΔPd corresponds to a value of the refrigerant flow rate Q.

Figure 3:
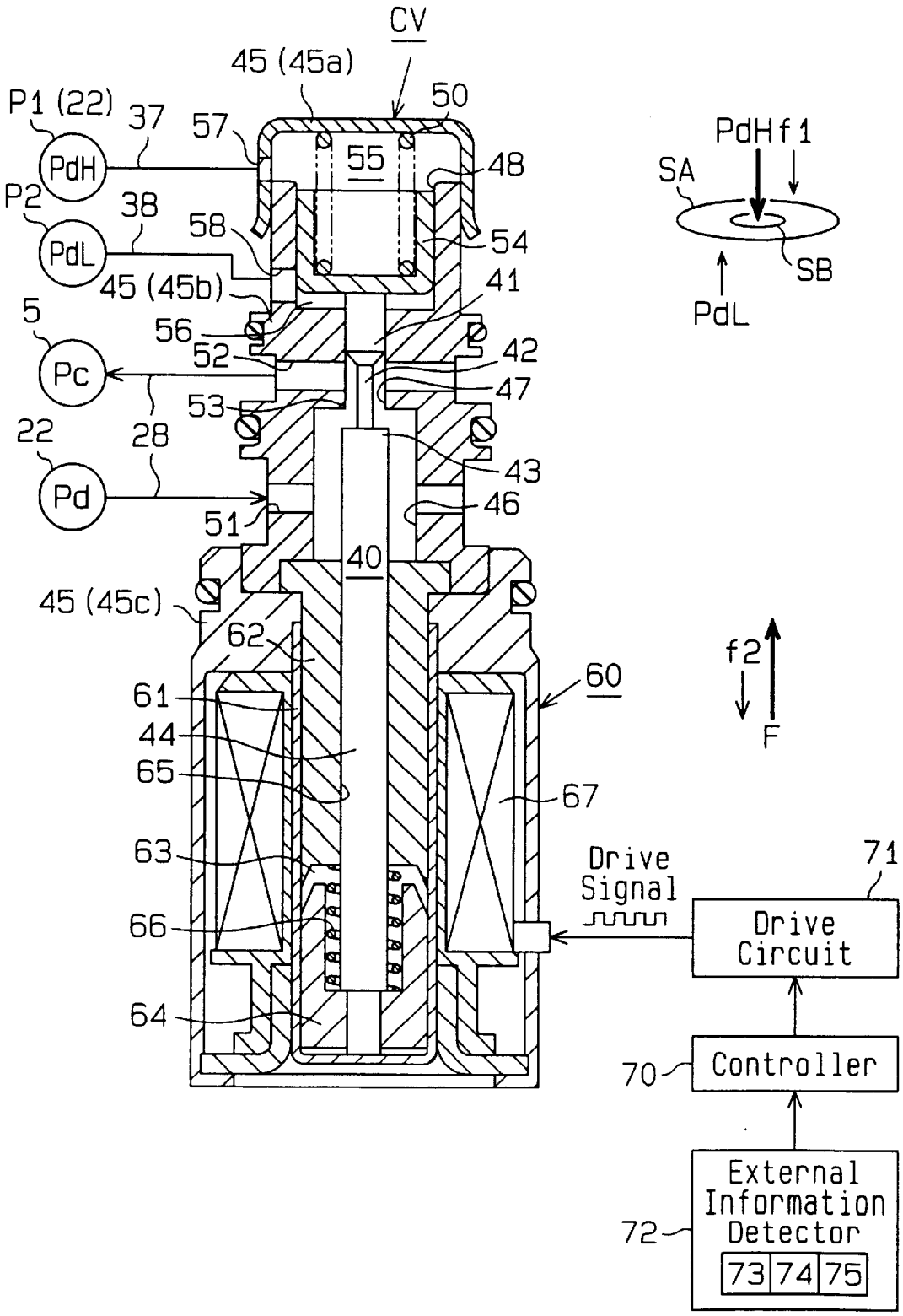
FIG. 3 is a cross-sectional view showing a displacement control valve of FIG. 1.

As shown in FIG. 3, the control valve CV has an inlet valve portion and a solenoid 60. The inlet valve portion controls the opening of the supply passage 28, which connects the discharge chamber 22 with the crank chamber 5. The solenoid 60 serves as an altering device or an electromagnetic actuator for controlling a rod 40 located in the control valve CV on the basis of an externally supplied electric current. The rod 40 has a distal end portion 41, a valve body 43, a connecting portion 42, which connects the distal end portion 41 and the valve body 43 with each other, and a guide 44. The valve body 43 is part of the guide 44.

A valve housing 45 of the control valve CV has a cap 45*a*, an upper half body 45*b* and a lower half body 45*c*. The upper half body 45*b* defines the shape of the inlet valve portion. The lower half body 45*c* defines the shape of the solenoid 60. A valve chamber 46 and a communication passage 47 are defined in the upper half body 45*b*. The upper half body 45*b* and the cap 45*a* define a pressure sensing chamber 48.

The rod 40 moves in the axial direction of the control valve CV, or vertically as viewed in the drawing, in the valve chamber 46 and the communication passage 47. The valve chamber 46 is selectively connected to and disconnected from the passage 47 in accordance with the position of the rod 40. The communication passage 47 is separated from the pressure sensing chamber 48 by the distal end portion 41 of the rod 40.

The bottom wall of the valve chamber 46 is formed by the upper end surface of a fixed iron core 62. A first radial port 51 allows the valve chamber 46 to communicate with the discharge chamber 22 through an upstream part of the supply passage 28. A second radial port 52 allows the communication passage 47 to communicate with the crank chamber 5 through a downstream part of the supply passage 28. Thus, the first port 51, the valve chamber 46, the communication passage 47, and the second port 52 form a part of the supply passage 28, which communicates the discharge chamber 22 with the crank chamber 5.

The valve body 43 of the rod 40 is located in the valve chamber 46. The inner diameter of the communication passage 47 is larger than the diameter of the connecting portion 42 of the rod 40 and is smaller than the diameter of the guide 44. That is, the opening area SB of the communication passage 47 (the cross sectional area of the distal end portion 41) is larger than the cross sectional area of the connecting portion 42 and smaller than the cross sectional area of the guide 44. A valve seat 53 is formed at the opening of the communication passage 47 (around the valve hole).

When the rod 40 moves from the lowest position shown in FIG. 3 to the highest position, at which the valve body 43 contacts the valve seat 53, the communication passage 47 is closed. Thus, the valve body 43 of the rod 40 serves as an inlet valve body that controls the opening of the supply passage 28.

A cup-shaped pressure sensing member 54 is located in the pressure sensing chamber 48. The pressure sensing member 54 moves axially in the pressure sensing chamber 48 and divides the pressure sensing chamber 48 into a first pressure chamber 55 and a second pressure chamber 56. The pressure sensing member 54 serves as a partition that separates the chambers 55 and 56 from each other and cuts off communication between the chambers 55 and 56. The cross sectional area SA of the pressure sensing member 54 is larger than the opening area SB of the communication passage 47.

A coil spring 50 is located in the first pressure chamber 55. The spring 50 urges the pressure sensing member 54 toward the second pressure chamber 56.

The first pressure chamber 55 communicates with the discharge chamber 22, and the first pressure monitoring point P1, through a port 57 formed in the cap 45*a* and through the first pressure introduction passage 37. The second pressure chamber 56 communicates with the second pressure monitoring point P2 through a port 58 formed in the upper half body 45*b* of the valve housing 45 and through the second pressure introduction passage 38. Therefore, the first pressure chamber 55 is exposed to the monitored pressure PdH of the first pressure monitoring point P1, and the second pressure chamber 56 is exposed to the monitored pressure PdL of the second pressure monitoring point P2.

The solenoid 60 includes a cup-shaped cylinder 61. A fixed iron core 62 is fitted in the upper part of the cylinder 61. A solenoid chamber 63 is defined in the cylinder 61. A movable iron core 64 is accommodated to move axially in the solenoid chamber 63. An axially extending guide hole 65 is formed in the central portion of the fixed iron core 62. The guide 44 of the rod 40 is located to move axially in the guide hole 65.

The proximal end of the rod 40 is accommodated in the solenoid chamber 63. More specifically, the lower end of the guide 44 is fitted in a hole formed at the center of the movable iron core 64 and fixed by crimping. Thus, the movable iron core 64 and the rod 40 move integrally and axially.

A valve body urging coil 66 is located between the fixed and movable iron cores 62 and 64 in the solenoid chamber 63. The spring 66 urges the movable iron core 64 away from the fixed iron core 62. The spring 66 urges the rod 40 (the valve body 43) downward.

A coil 67 is wound about the fixed core 62 and the movable core 64. The coil 67 receives drive signals from a drive circuit 71 based on commands from a controller 70. The coil 67 generates an electromagnetic force F that corresponds to the value of the current from the drive circuit 71. The electromagnetic force F urges the movable core 64 toward the fixed core 62. The electric current supplied to the coil 67 is controlled by controlling the voltage applied to the coil 67. This embodiment employs duty control for controlling the applied voltage.

The position of the rod 40 in the control valve CV, i.e., the valve opening of the control valve CV, is determined as follows. In the following description, the influence of the pressure of the valve chamber 46, the communication passage 47, and the solenoid chamber 63 on the position of the rod 40 will not be taken into account.

When no current is supplied to the coil 67 (Dt=0%) as shown in FIG. 3, the downward force f1+f2 of the springs 50 and 66 is dominant. As a result, the rod 40 is moved to its lowermost position and causes the valve body 43 to fully open the communication passage 47. Accordingly, the crank pressure Pc is maximized under the current circumstances. Therefore, the difference between the crank pressure Pc and the pressure in the cylinder bores 1*a* is great, which minimizes the inclination angle of the swash plate 12 and the compressor displacement.

When a current of the minimum duty ratio Dt(min) is supplied to the coil 67, the upward electromagnetic force F is greater than the downward force f1+f2 of the springs 50 and 66, which moves the rod 40 upward. The upward electromagnetic force F is weakened by the downward force f2 of the spring 66. The net upward force (F−f2) acts against the net downward force of the downward force f1 of the spring 50 and the force based on the pressure difference ΔPd. Thus the valve body 43 of the rod 40 is positioned relative to the valve seat 53 to satisfy the following equation:

$$PdH \cdot SA - PdL(SA - SB) = F - f1 - f2$$

For example, if the flow rate of the refrigerant in the refrigerant circuit is decreased because of a decrease in speed of the engine E, the downward force based on the pressure difference ΔPd between the two points decreases, and the electromagnetic force F, at this time, cannot balance the forces acting on the rod 40. Therefore, the rod 40 moves upward, which compresses the springs 50 and 66. The valve body 43 of the rod 40 is positioned such that the increase in the downward force f1+f2 of the springs 50 and 66 compensates for the decrease in the downward force between on the pressure difference ΔPd between the two points. As a result, the opening of the communication passage 47 is reduced and the crank pressure Pc is decreased. As a result, the difference between the crank pressure Pc and the pressure in the cylinder bores 1*a* is reduced, the inclination angle of the swash plate 12 is increased, and the displacement of the compressor is increased. The increase in the displacement of the compressor increases the flow rate of the refrigerant in the refrigerant circuit to increase the pressure difference ΔPd between the two points.

In contrast, when the flow rate of the refrigerant in the refrigerant circuit is increased due to an increase in the speed of the engine E, the downward force based on the pressure difference ΔPd between the two points increases and the current electromagnetic force F cannot balance the forces acting on the rod 40. Therefore, the rod 40 moves downward, which expands the springs 50 and 66. The valve body 43 of the rod 40 is positioned such that the decrease in the downward force f1+f2 of the springs 50 and 66 compensates for the increase in the downward force based on the pressure difference ΔPd between the two points. As a result, the opening of the communication passage 47 is increased, the crank pressure Pc is increased, and the difference between the crank pressure Pc and the pressure in the cylinder bores 1*a* is increased. Accordingly, the inclination angle of the swash plate 12 is decreased, and the displacement of the compressor is also decreased. The decrease in the displacement of the compressor decreases the flow rate of the refrigerant in the refrigerant circuit, which decreases the pressure difference ΔPd.

When the duty ratio Dt of the electric current supplied to the coil 67 is increased to increase the electromagnetic force F, the pressure difference ΔPd between the two points cannot balance the forces on the rod 40. Therefore, the rod 40 moves upward, which compresses the springs 50 and 66. The valve body 43 of the rod 40 is positioned such that the increase in the downward force f1+f2 of the springs 50 and 66 compensates for the increase in the upward electromagnetic force F. As a result, the opening of the control valve CV, or the opening of the communication passage 47, is reduced and the displacement of the compressor is increased. Accordingly, the flow rate of the refrigerant in the refrigerant circuit is increased to increase the pressure difference ΔPd.

When the duty ratio Dt of the electric current supplied to the coil 67 is decreased and the electromagnetic force F is decreased accordingly, the pressure difference ΔPd between the two points cannot balance the forces acting on the rod 40.

Therefore, the rod 40 moves downward, which decreases the downward force f1+f2 of the springs 50 and 66. The valve body 43 of the rod 40 is positioned such that the decrease in the force f1+f2 of the springs 50 and 66 compensates for the decrease in the upward electromagnetic force F. As a result, the opening of the communication passage 47 is increased and the displacement of the compressor is decreased. Accordingly, the flow rate of the refrigerant in the refrigerant circuit is decreased, which decreases the pressure difference ΔPd.

As described above, the target value of the pressure difference ΔPd is determined by the electromagnetic force F. The control valve CV automatically determines the position of the rod 40 according to changes of the pressure difference ΔPd to maintain the target value of the pressure difference ΔPd. The target value of the pressure difference ΔPd is varied between a minimum value, which corresponds to the minimum duty ratio Dt(min), and a maximum value, which corresponds to the maximum duty ratio Dt(max), for example 100%.

As shown in FIGS. 2 and 3, the vehicle air conditioner has a controller 70. The controller 70 is a computer control unit including a CPU, a ROM, a RAM, and an I/O interface. An external information detector 72 is connected to the input terminal of the I/O interface. A drive circuit 71 is connected to the output terminal of the I/O interface.

The controller 70 performs an arithmetic operation to determine a proper duty ratio Dt on the basis of various pieces of external information, which is detected by the external information detector 72, and instructs the drive circuit 71 to output a drive signal corresponding to the duty ratio Dt. The drive circuit 71 outputs the drive signal of the instructed duty ratio Dt to the coil 67. The electromagnetic force F by the solenoid 60 of the control valve CV varies in accordance with the duty ratio Dt of the drive signal supplied to the coil 67.

The external information detector 72 is a group of devices for detecting the external information that reflects the cooling performance required for the refrigerant circuit. Sensors of the external information detector 72 include, e.g., an A/C switch (ON/OFF switch of the air conditioner operated by the passenger or the like) 73, a temperature sensor 74 for detecting an in-vehicle temperature Te(t), and a temperature setting unit 75 for setting a desired target value Te(set) of the in-vehicle temperature.

Figure 6:
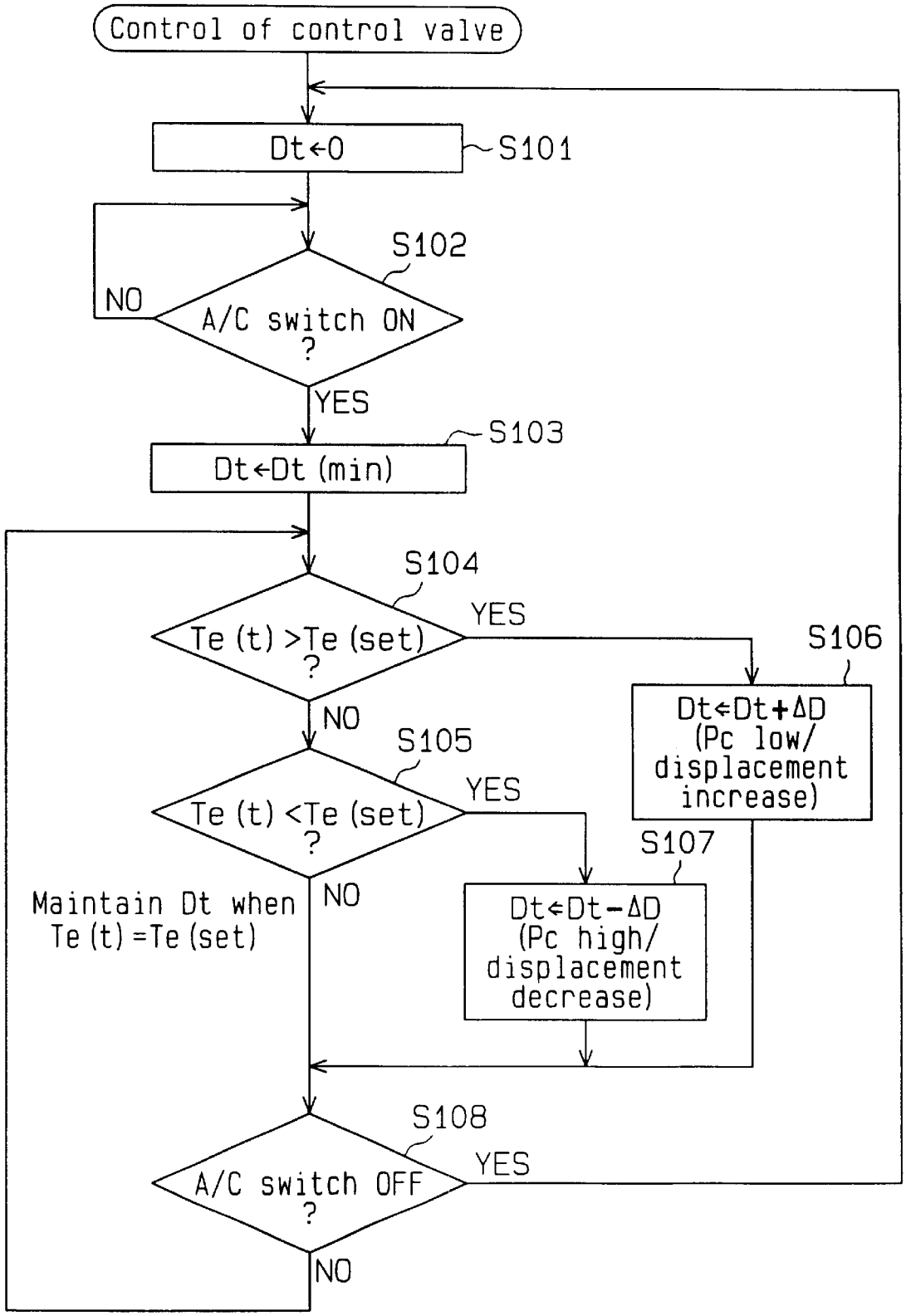
FIG. 6 is a flowchart indicating a control procedure of the displacement control valve.

Next, the duty control of the control valve CV by the controller 70 will be described with reference to the flowchart of FIG. 6.

When the ignition switch (or the start switch) of the vehicle is turned on, the controller 70 is supplied with an electric current to start processing. In step S101, the controller 70 makes various initializations. For example, the controller 70 sets an initial duty ratio Dt of zero. After this, condition monitoring and internal processing of the duty ratio Dt are performed.

In step S102, the controller 70 monitors the ON/OFF state of the A/C switch 73 until the switch 73 is turned on. When the A/C switch 73 is turned on, in step S103, the controller 70 sets the duty ratio Dt of the control valve CV to the minimum duty ratio Dt(min) and starts the internal self-control function (target pressure difference maintenance) of the control valve CV.

In step S104, the controller 70 judges whether the detected temperature Te(t) by the temperature sensor 74 is higher than the target temperature Te(set). If step S104 is negative, in step S105, the controller 70 further judges whether the detected temperature Te(t) is lower than the target temperature Te(set). When step S105 is negative, then the detected temperature Te(t) is equal to the target temperature Te(set). Therefore, the duty ratio Dt need not be changed. Thus, the controller 70 does not instruct the drive circuit 71 to change the duty ratio Dt and step S108 is performed.

If step S104 is positive, the interior of the vehicle is hot and the thermal load is high. Therefore, in step S106, the controller 70 increases the duty ratio Dt by a unit quantity ΔD and instructs the drive circuit 71 to increment the duty ratio Dt to a new value (Dt+ΔD). As a result, the valve opening of the control valve CV is somewhat reduced, the displacement of the compressor is increased, the ability of the evaporator 33 to transfer heat is increased, and the temperature Te(t) is lowered.

If step S105 is positive, the interior of the vehicle is relatively cool and the thermal load is low. Therefore, in step S107, the controller 70 decrements the duty ratio Dt by a unit quantity ΔD, and instructs the drive circuit 71 to change the duty ratio Dt to the new value (Dt−ΔD). As a result, the valve opening of the control valve CV is somewhat increased, the displacement of the compressor is decreased, the ability of the evaporator 33 to transfer heat is reduced, and the temperature Te(t) is raised.

In step S108, it is judged whether or not the A/C switch 73 is turned off. If step S108 is negative, step S104 is performed. When step S108 is positive, step S101, in which the supply of the current to the control valve CV is stopped, is performed.

As described above, by changing the duty ratio Dt in step S106 and/or S107, even when the detected temperature Te(t) deviates from the target temperature Te(set), the duty ratio Dt is gradually optimized and the detected temperature Te(t) converges to the vicinity of the target temperature Te(set).

The above illustrated embodiment has the following advantages.

(1) In the first embodiment, the suction pressure Ps, which is influenced by the thermal load in the evaporator 33, is not directly referred to for controlling the opening of the control valve CV. Instead, the pressure difference ΔPd between the pressure monitoring points P1 and P2 in the refrigerant circuit is directly controlled for feedback controlling the displacement of the compressor. Therefore, the displacement is scarcely influenced by the thermal load of the evaporator 33. In other words, the displacement is quickly and accurately controlled by external control of the controller 70.

(2) Two comparison examples will hereafter be discussed. In each example, a fixed restrictor, instead of the pressure difference adjusting valve 39 of the first embodiment, is located between the first pressure monitoring point P1 and the second pressure monitoring point P2. In Example 1, the restriction amount of the refrigerant by the fixed restrictor is equal to that of the pressure difference adjusting valve 39 in the state of FIG. 4(*a*). In Example 2, the restriction amount of the refrigerant by the fixed restrictor is equal to that of the pressure difference adjusting valve 39 in the state of FIG. 4(*b*).

As shown in FIG. 5, the pressure ratio of the first pressure monitoring point P1 to the second pressure monitoring point P2 is increased in Example 1 in which the restriction amount of the refrigerant by the fixed restrictor is relatively large. Thus, the pressure difference ΔPd between the pressure monitoring points P1, P2 is varied at a relatively high rate with respect to the variation in the refrigerant flow rate Q. Accordingly, as long as the refrigerant flow rate Q remains in the relatively low range, the refrigerant flow rate Q can be controlled accurately by altering the duty ratio Dt in a relatively large range. However, if the refrigerant flow rate Q is in the relatively high range, the pressure difference ΔPd between the pressure monitoring points P1, P2 becomes excessively high. In this state, even though the duty ratio Dt is maximized, or the target value of the pressure difference ΔPd is maximized, the corresponding refrigerant flow rate Q remains relatively small. This makes it impossible to increase the maximum controllable flow rate Qmax in the refrigerant circuit.

In Example 2 in which the restriction amount of the refrigerant by the fixed restrictor is relatively small, the pressure ratio of the first pressure monitoring point P1 to the second pressure monitoring point P2 is decreased. Thus, the pressure difference ΔPd between the pressure monitoring points P1, P2 is varied at a relatively low rate with respect to the variation in the refrigerant flow rate Q. Accordingly, if the duty ratio Dt is maximized, or the target value of the pressure difference ΔPd is maximized, the corresponding refrigerant rate Q becomes relatively large. It is thus possible to increase the maximum controllable flow rate Qmax in the refrigerant circuit. However, as long as the refrigerant flow rate Q is varied in the relatively low range, the pressure difference ΔPd is varied at an excessively low rate with respect to the variation in the refrigerant flow rate Q. In this state, or if the refrigerant flow rate Q is varied in the relatively low range, the duty ratio Dt must be varied in a relatively small range, thus decreasing the control accuracy of the refrigerant flow rate Q.

In contrast, in the illustrated embodiment, the pressure difference adjusting valve 39 located between the first and second pressure monitoring point P1, P2 functions as a variable restrictor. The pressure difference adjusting valve 39 automatically adjusts the restriction amount of the refrigerant in relation to the refrigerant flow rate Q. Thus, the relationship between the refrigerant flow rate Q and the pressure difference ΔPd may be altered to obtain characteristics like those of Example 1 or Example 2 (as indicated by the solid lines in FIG. 5). The pressure difference adjusting valve 39 increases the restriction amount of the refrigerant if the refrigerant flow rate Q is in the relatively low range. In contrast, the pressure difference adjusting valve 39 decreases the restriction amount of the refrigerant if the refrigerant flow rate Q is in the relatively high range. Accordingly, the pressure difference adjusting valve 39 optimally controls the refrigerant flow rate Q when the refrigerant flow rate Q is in the relatively low range. Further, it is possible to increase the maximum controllable refrigerant flow rate Qmax.

(3) A compressor for a vehicle air conditioner is generally accommodated in small engine compartment, which limits the size of the compressor. Therefore, the size of the control valve CV and the size of the solenoid 60 (coil 67) are limited. Also, the solenoid 60 is generally driven by a battery that is used for controlling the engine. The voltage of the battery is, for example, between twelve to twenty-four volts.

To increase the maximum controllable flow rate Qmax in the comparison example 1 of FIG. 5, the maximum level of the electromagnetic force F of the solenoid 60, which represents the maximum pressure difference, may be increased. To increase the maximum level of the electromagnetic force F, the size of the coil 67 must be increased or the voltage of the power source must be increased. However, this requires a significant change of the existing design of the surrounding devices and is therefore almost impossible. In the illustrate embodiment, the pressure difference adjusting valve 39 alters the relationship between the refrigerant flow rate Q and the pressure difference ΔPd as desired. It is thus possible to increase the maximum controllable flow rate Qmax without enlarging the coil 67 or increasing the voltage of the power source. Further, the refrigerant flow rate Q is optimally controlled when the refrigerant flow rate Q is in the relatively low range.

(4) The pressure difference adjusting valve 39 is operated in accordance with the pressure difference between the upstream side and the downstream side of the pressure difference adjusting valve 39. It is thus unnecessary to provide a sensor for electrically detecting the refrigerant flow rate Q in the refrigerant circuit or a control device for operating the valve body 83 of the pressure difference adjusting valve 39 in accordance with the detecting result of the sensor. This decreases the cost for the air conditioner.

(5) The pressure difference ΔPd in the control valve CV is mechanically detected and directly affects the position of the rod 40 (the valve body 43). Therefore, the control valve CV does not require an expensive pressure sensor for electrically detecting the pressure difference ΔPd. This reduces the number of parameters for computing the duty ratio Dt and, thus, reduces the calculation load of the controller 70.

(6) The section of the flow pipe 36 between the pressure monitoring points P1, P2 functions as the pressure difference adjusting line 36*a*. It is thus unnecessary to form a separate pressure difference adjusting line.

Second Embodiment

Figure 7:
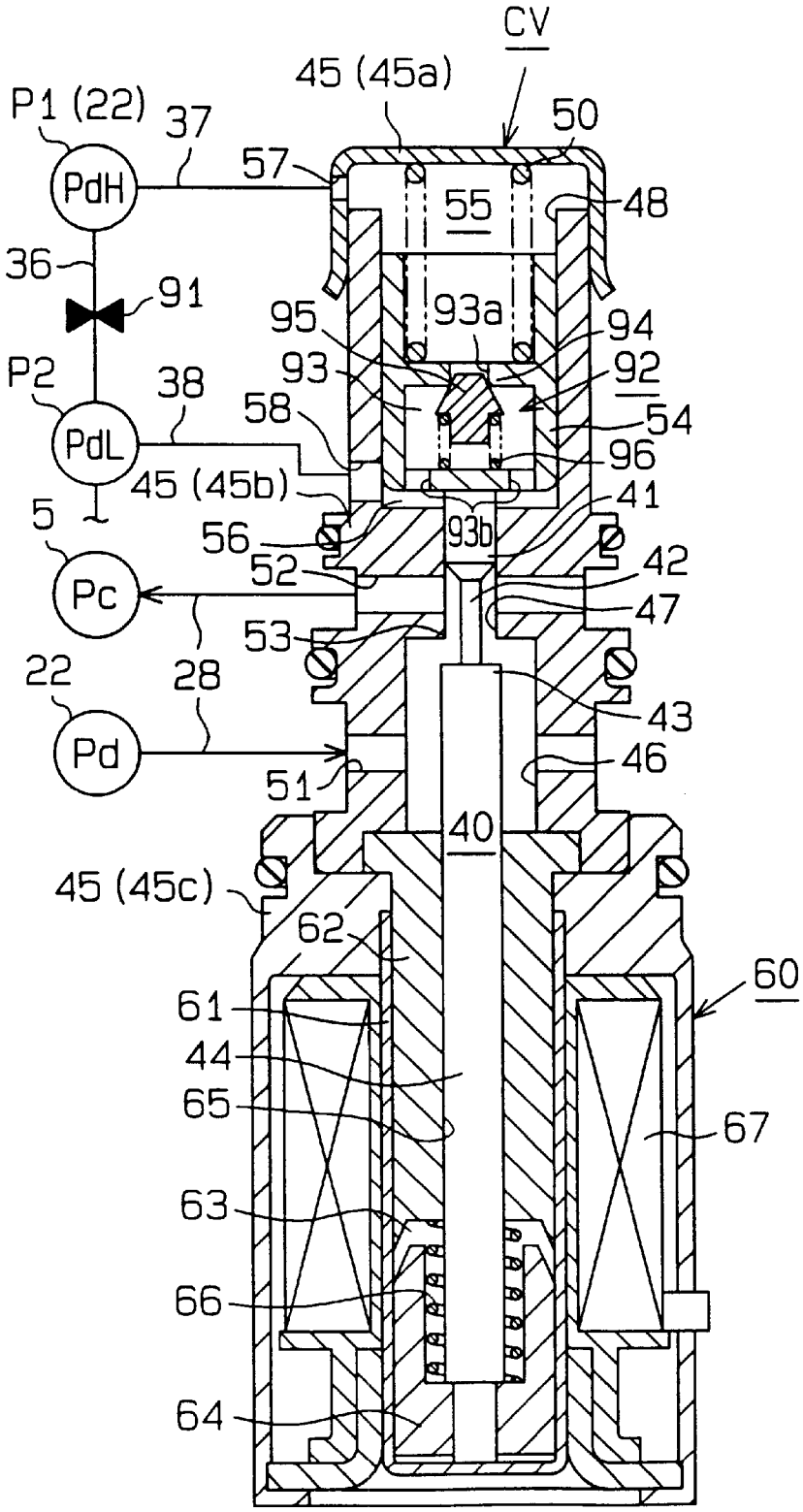
FIG. 7 is a cross-sectional view showing a displacement control valve of a second embodiment according to the present invention.

As shown in FIG. 7, a fixed restrictor 91, instead of the pressure difference adjusting valve 39, is located in the section of the flow pipe 36 between the first pressure monitoring point P1 and the second pressure monitoring point P2. The restriction amount of the refrigerant by the fixed restrictor 91 is equal to the restriction amount of the refrigerant by the pressure difference adjusting valve 39 in the state of FIG. 4(*a*). A pressure difference adjusting valve 92, which is a variable restrictor or a variable throttle valve, is located in the control valve CV at a position between the first pressure chamber 55 and the second pressure chamber 56. The pressure difference adjusting valve 92 is located parallel with the flow pipe 36.

The pressure difference adjusting valve 92 will now be described in detail. A valve chamber 93 is formed in the pressure sensing member 54 at a position between the first pressure chamber 55 and the second pressure chamber 56. The valve chamber 93 is connected to the first pressure chamber 55 through a first communication passage 93*a*. The valve chamber 93 is connected to the second pressure chamber 56 through a plurality of communication passages 93*b*. The first communication passage 93*a*, the valve chamber 93, and the second communication passages 93*b* form a pressure difference adjusting line that connects the first pressure chamber 55, or a high pressure zone, to the second pressure chamber 56, or a low pressure zone.

A wall section of the first communication passage 93*a* that forms an opening to the valve chamber 93 functions as a valve seat 94. A valve body 95 is located in the valve chamber 93. The valve body 95 is moved selectively to contact and be separated from the valve seat 94. The first communication passage 93*a* functions as a valve hole that is selectively opened and closed by the valve body 95. An urging spring 96 is located in the valve chamber 93 to urge the valve body 95 toward the valve seat 94.

The opening area of the first communication passage 93*a*, which is altered by the valve body 95, is determined in accordance with equilibrium among the force generated by the difference between the pressure in the first pressure chamber 55 and the pressure in the second pressure chamber 56, both of which act on the valve body 95, and the force of the urging spring 96, which also acts on the valve body 95. The force generated by the pressure difference between the first pressure chamber 55 and the second pressure chamber 56 urges the valve body 95 to open the first communication passage 93*a*. In contrast, the force of the urging spring 96 urges the valve body 95 to close the first communication passage 93*a*. As explained regarding the first embodiment shown in FIGS. 1 to 6, the pressure difference between the first pressure chamber 55 and the second pressure chamber 56, which is the difference ΔPd between the pressure PdH at the first pressure monitoring point P1 and the pressure PdL the second pressure monitoring point P2, is varied in relation to the refrigerant flow rate Q in the refrigerant circuit. Thus, the opening size of the pressure difference adjusting valve 92 is adjusted in accordance with the refrigerant flow rate Q in the refrigerant circuit.

Figure 9:
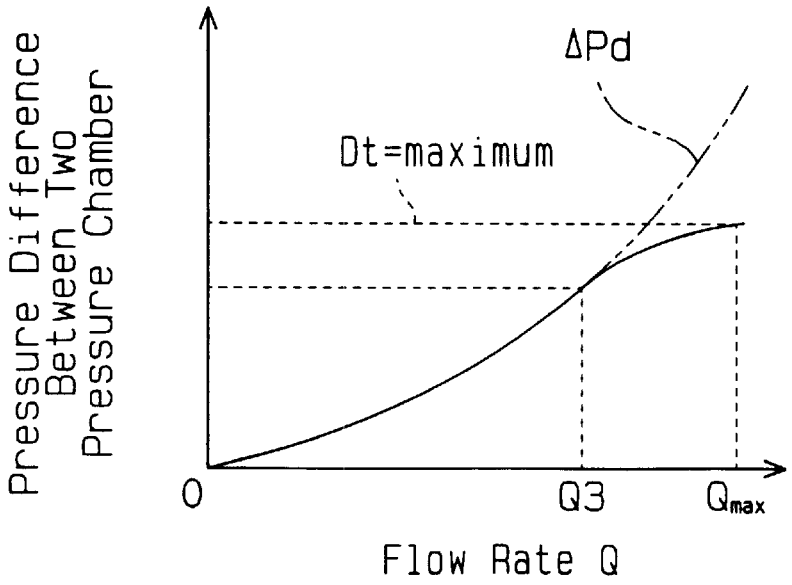
FIG. 9 is a graph representing the relationship between refrigerant flow and pressure difference between a pair of pressure chambers.

For example, if the refrigerant flow rate Q in the refrigerant circuit is in a relatively low range which is less than the predetermined value Q3 or an intermediate range, the pressure difference between the first pressure chamber 55 and the second pressure chamber 56 is relatively small (see FIG. 9). The force generated by the pressure difference between the first and second pressure chambers 55, 56, which urges the valve body 95 to open the first communication passage 93*a*, is thus smaller than the force of the urging spring 96, which urges the valve body 95 to close the first communication passage 93*a*. Accordingly, as shown in FIG. 7, the valve body 95 contacts the valve seat 94, thus closing the first communication passage 93*a*.

When the first communication passage 93*a* is closed, the pressure difference between the first pressure chamber 55 and the second pressure chamber 56 is equal to the pressure difference ΔPd between the first pressure monitoring point P1 and the second pressure monitoring point P2. The restriction amount of the refrigerant by the fixed restrictor 91, which is located between the first pressure monitoring point P1 and the second pressure monitoring point P2, is relatively large. The pressure ratio of the first pressure monitoring point P1 to the second pressure monitoring point P2, or the pressure ratio of the first pressure chamber 55 to the second pressure chamber 56, is thus relatively large. Accordingly, as shown in FIG. 9, the pressure difference between the first and second pressure chambers 55, 56 is varied with a relatively high rate with respect to variation in the refrigerant flow rate Q. As a result, the refrigerant flow rate Q is controlled with an increased accuracy particularly when the refrigerant flow rate Q is in the relatively low range.

Figure 8:
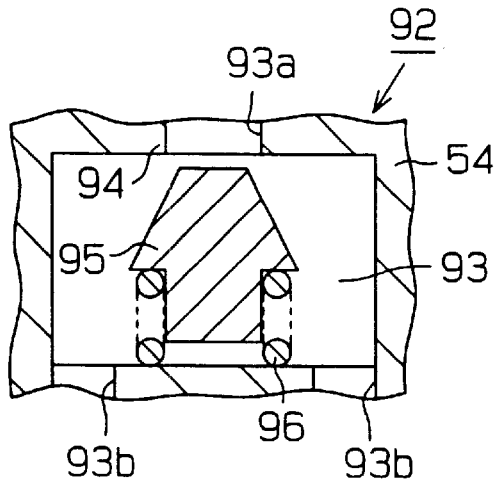
FIG. 8 is an enlarged cross-sectional view showing a pressure difference adjusting valve incorporated in the displacement control valve of FIG. 7.

When the refrigerant flow rate Q in the refrigerant circuit is in a relatively high range, which is more than the value Q3, the force generated by the pressure difference between the pressure chambers 55, 56 is greater than the force of the urging spring 96. Accordingly, as shown in FIG. 8, the valve body 95 is separated from the valve seat 94, thus opening the first communication passage 93*a*.

When the first communication passage 93*a* is open, the pressure in the first pressure chamber 55 is supplied to the second pressure chamber 56 through the pressure difference adjusting line (the first communication passage 93*a*, the valve chamber 93, and the second communication passages 93*b*). The pressure in the first pressure chamber 55 thus becomes smaller than the pressure PdH at the first pressure monitoring point P1. In contrast, the pressure in the second pressure chamber 56 becomes greater than the pressure PdL at the second pressure monitoring point P2. In this state, the pressure ratio of the first pressure chamber 55 to the second pressure chamber 56 is relatively small, as compared to when the first communication passage 93*a* is closed. Accordingly, as shown in FIG. 9, the pressure difference between the first pressure chamber 55 and the second pressure chamber 56 is varied at a relatively low rate with respect to the variation in the refrigerant flow rate Q. As a result, if the duty ratio Dt is maximized, or the target value of the pressure difference ΔPd between the first and second pressure monitoring points P1, P2 is maximized, the corresponding refrigerant flow rate Q becomes relatively large. This makes it possible to increase the maximum controllable refrigerant flow rate Qmax in the refrigerant circuit.

In addition to the advantages (1) to (5) of the first embodiment, which is illustrated in FIGS. 1 to 6, the second embodiment has the following advantages.

(1) The pressure difference adjusting line (the first communication passage 93*a*, the valve chamber 93, and the second communication passages 93*b*), which is located between the first pressure chamber 55 and the second pressure chamber 56, is located parallel with the flow pipe 36. Unlike the flow pipe 36, which forms a relatively large passage in which the refrigerant flows from the discharge chamber 22 of the compressor, the pressure difference adjusting line is a relatively small refrigerant passage used for controlling the compressor displacement. Accordingly, the pressure difference adjusting valve 92, which is located in the pressure difference adjusting line, becomes relatively small. The pressure difference adjusting valve 92 is thus easily incorporated in the control valve CV.

(2) The pressure difference adjusting valve 92 is incorporated in the control valve CV. It is thus unnecessary to handle the pressure adjusting valve 92 separately from the control valve CV when assembling the air conditioner. The air conditioner is thus efficiently and easily assembled.

Third Embodiment

Figure 10:
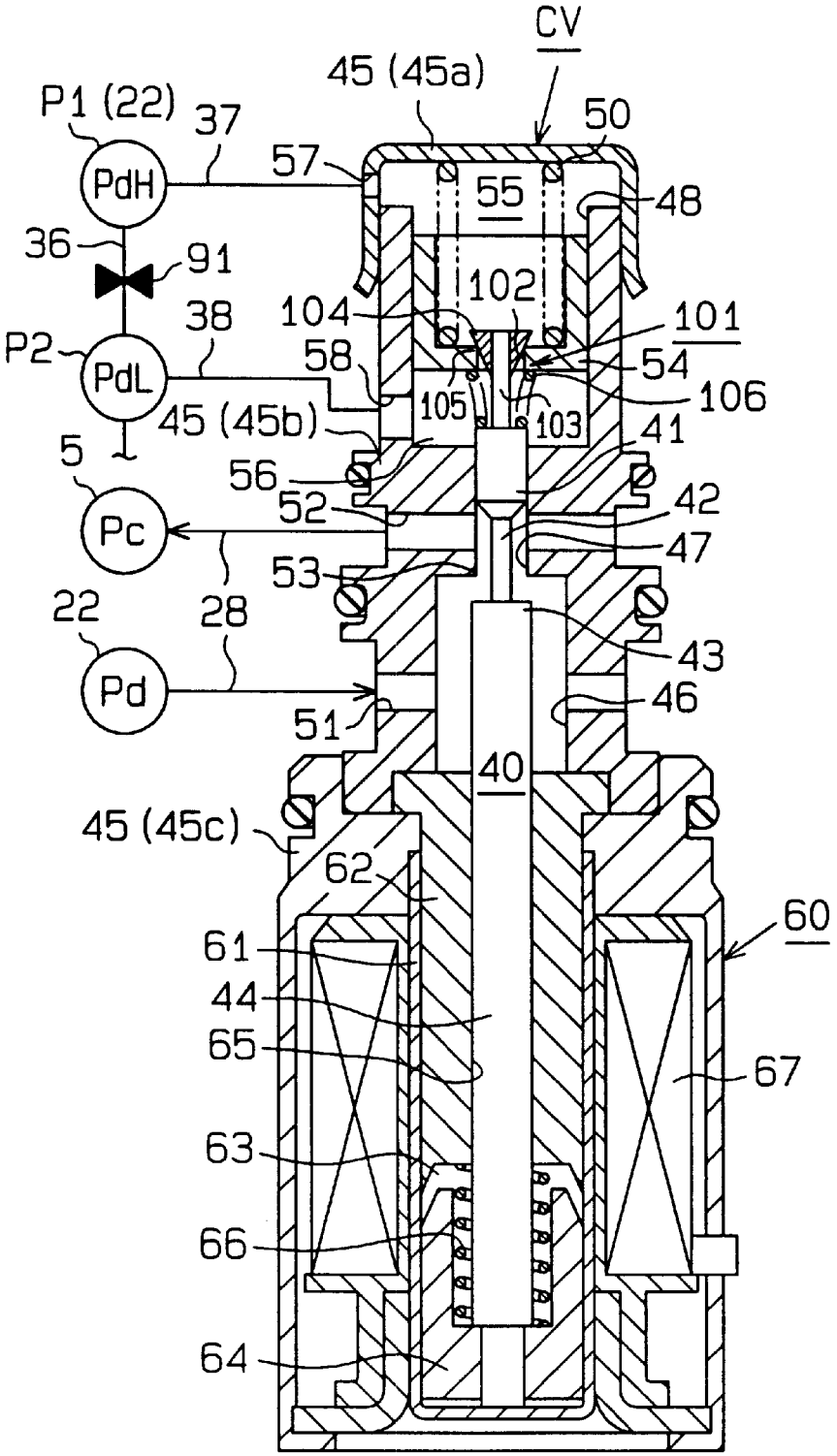
FIG. 10 is a cross-sectional view showing a displacement control valve of a third embodiment according to the present invention.

As shown in FIG. 10, a pressure difference adjusting valve 101 of the third embodiment according to the present invention has a different structure from that of the pressure difference adjusting valve 92 of the second embodiment, which is shown in FIGS. 7 to 9. More specifically, a pressure difference adjusting line 102 extends through a base wall of the pressure sensing member 54 to connect the first pressure chamber 55 to the second pressure chamber 56. A support rod 103 projects from an end of the distal end portion 41 of the rod 40. The support rod 103 thus extends from the second pressure chamber 56 to the first pressure chamber 55 through the pressure difference adjusting line 102. A valve body 104 is secured to the distal end of the support rod 103 and is received in the first pressure chamber 55. A wall section of the pressure difference adjusting line 102 that forms an opening to the first pressure chamber 55 functions as a valve seat 105. The valve body 104 contacts the valve seat 105.

The pressure sensing member 54 moves relative to the rod 40, thus moving the valve body 104 to contact or be separated from the valve seat 105. An urging spring 106 is located between the pressure sensing member 54 and the distal end portion 41 of the rod 40. The urging spring 106 urges the pressure sensing member 54 and the rod 40 to move away from each other. That is, the urging spring 106 generates the force that urges the valve seat 105 and the valve body 104 toward each other.

The opening size of the pressure difference adjusting line 102, which is altered by the valve body 104, is determined in accordance with equilibrium among the force caused by the difference between the pressure in the first pressure chamber 55 and the pressure in the second pressure chamber 56, both of which act on the pressure sensing member 54, the force f1 of the spring 50 applied to the pressure sensing member 54, and the force of the urging spring 106. The force generated by the pressure difference between the first pressure chamber 55 and the second pressure chamber 56 and the force f1 of the spring 50 both act to move the valve seat 105 and the valve body 104 away from each other.

For example, if the refrigerant flow rate Q in the refrigerant circuit is in the relatively low range which is less than the predetermined valve Q3 or the intermediate range, the pressure difference between the first pressure chamber 55 and the second pressure chamber 56 is relatively small (see FIG. 9). Thus, the force resulting from the force caused by the pressure difference between the pressure chambers 55, 56 and the force f1 of the spring 50 is smaller than the force of the urging spring 106. In this state, as shown in FIG. 10, the valve body 104 contacts the valve seat 105, thus closing the pressure difference adjusting line 102.

Figure 11:
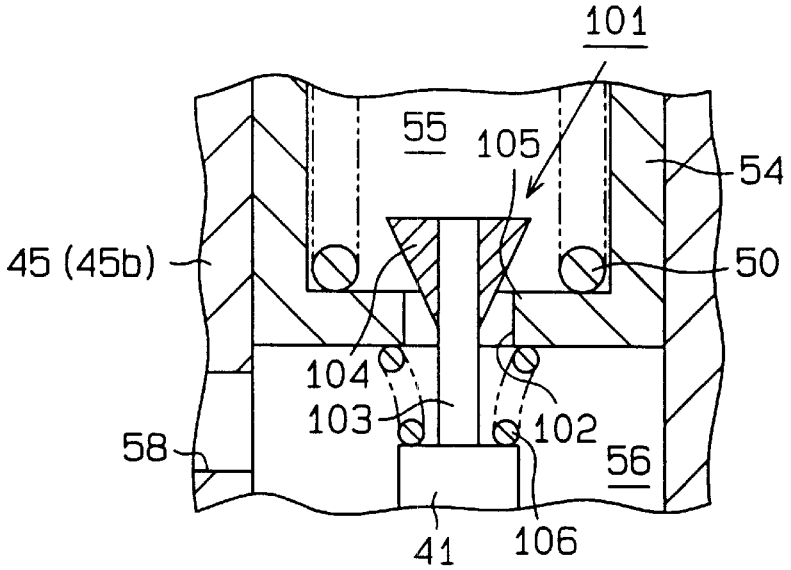
FIG. 11 is an enlarged, cross-sectional view showing a pressure difference adjusting valve incorporated in the displacement control valve of FIG. 10.

If the refrigerant flow rate Q in the refrigerant circuit is in the relatively high range, which is more than the value Q3, the force resulting from the force caused by the pressure difference between the pressure chambers 55, 56 and the force f1 of the spring 50 is larger than the force of the urging spring 106. In this state, as shown in FIG. 11, the valve body 104 is separated from the valve seat 105, thus opening the pressure difference adjusting line 102.

As described, the third embodiment of the present invention operates in the same manner as the second embodiment, which is illustrated in FIGS. 7 to 9, and has the same advantages as those of the second embodiment.

Fourth Embodiment

Figure 12A:
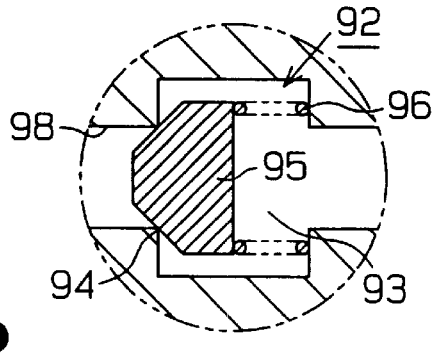
FIG. 12A is an enlarged view showing the portion indicated by circle 12A of FIG. 12.
Figure 12:
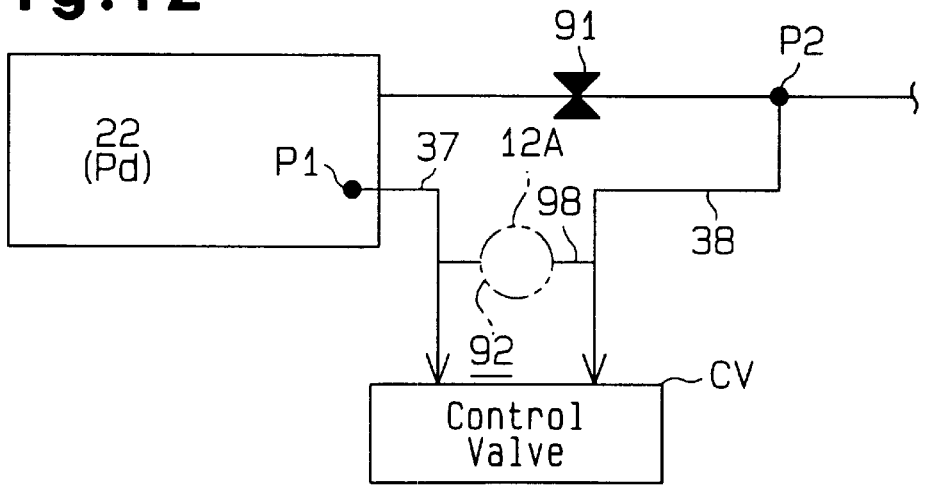
FIG. 12 is a view showing a portion of a refrigerant circuit of a fourth embodiment according to the present invention.

The fourth embodiment of the present invention is different from the second embodiment in the following points. More specifically, as shown in FIGS. 12 and 12A, the first pressure introduction passage 37, or a high pressure zone, and the second pressure introduction passage 38, or a low pressure zone, are connected to each other through a pressure difference adjusting line 98, which is located in the exterior of the control valve CV. A pressure difference adjusting valve 92 is located in the pressure difference adjusting line 98.

In the fourth embodiment, like the second embodiment illustrated in FIGS. 7 to 9, the pressure difference adjusting valve 92 opens the pressure difference adjusting line 98 if the refrigerant flow rate Q in the refrigerant circuit is in the relatively high range, which is more than the value Q3 (see FIG. 9). Accordingly, some pressure supplied from the first pressure monitoring point P1 to the first pressure chamber 55 through the first pressure introduction passage 37 is provided to the second pressure chamber 56 through the pressure difference adjusting line 98 and the second pressure introduction passage 38. As a result, the pressure in the first pressure chamber 55 becomes smaller than the pressure PdH at the first pressure monitoring point P1. In contrast, the pressure in the second pressure chamber 56 becomes larger than the pressure PdL at the second pressure monitoring point P2.

In this state, the pressure ratio of the first pressure chamber 55 to the second pressure chamber 56 becomes smaller, as compared to when the pressure difference adjusting line 98 is closed. The pressure difference between the first and second pressure chambers 55, 56 is thus varied at a relatively low rate with respect to variation in the refrigerant flow rate Q, as indicated by the graph of FIG. 9. This makes it possible to increase the maximum controllable refrigerant flow rate Qmax in the refrigerant circuit.

The fourth embodiment of the present invention has the same advantages as the items (1) to (5) of the first embodiment and the item (1) of the second embodiment.

The present invention may be embodied as the following modifications without departing from the sprit of the present invention.

The arrangement of the pressure difference adjusting line, which is provided with the pressure difference adjusting valve, may be modified as long as the passage connects a high pressure zone between the first pressure monitoring point P1 and the first pressure chamber 55 to a low pressure zone between the second pressure monitoring point P2 and the second pressure chamber 56.

As labeled as another embodiment in FIG. 2, the first pressure monitoring point P1 may be located between the evaporator 33 and the suction chamber 21 (in the pipe 35 in the drawing), and the second pressure monitoring point P2 may be located in the suction pressure zone and downstream of the first pressure monitoring point P1 (in the suction chamber 21 in the drawing).

The first pressure monitoring point P1 may be located between the discharge chamber 22 and the condenser 31, and the second pressure monitoring point P2 may be located between the evaporator 33 and the suction chamber 21.

The pressure difference adjusting valve may be a manually operated type.

The control valve may be a so-called outlet control valve for controlling the crank pressure Pc by controlling the opening of the bleed passage 27.

The present invention can be embodied in an air conditioner having a wobble type variable displacement compressor.

A clutch mechanism such as an electromagnetic clutch may be employed as the power transmission mechanism PT.

Therefore, the present examples and embodiments are to be considered as illustrative and not restrictive and the invention is not to be limited to the details given herein, but may be modified within the scope and equivalence of the appended claims.

What is claimed is:

1. An air conditioning apparatus provided with a refrigerant circuit including a variable displacement compressor, comprising:

a displacement control mechanism, which controls the displacement of the compressor in relation to a pressure difference between a first pressure monitoring point and a second pressure monitoring point in the refrigerant circuit such that the pressure difference seeks a predetermined target value, wherein the second pressure monitoring point is located downstream of the first pressure monitoring point, and the displacement control mechanism has an altering device for altering the target value;

a first pressure introducing passage, which introduces the pressure at the first pressure monitoring point to the displacement control mechanism, wherein the first pressure monitoring point and the first pressure introducing passage form a high pressure zone;

a second pressure introducing passage, which introduces the pressure at the second pressure monitoring point to the displacement control mechanism, wherein the second pressure monitoring point and the second pressure introducing passage form a low pressure zone;

an adjusting line, which connects the high pressure zone to the low pressure zone; and an adjusting valve, which adjusts the opening size of the adjusting line.

2. The air conditioning apparatus as set forth in claim 1, wherein the compressor includes a crank chamber, an inclinable drive plate, which is accommodated in the crank chamber, and a piston, which is reciprocated by the drive plate, wherein an inclination angle of the drive plate is varied in accordance with the pressure in the crank chamber, the inclination angle of the drive plate determines a stroke of the piston and the displacement of the compressor, the displacement control mechanism includes a control valve located in the compressor, and the control valve is operated depending on the difference between the pressure at the first monitoring point and the pressure at the second pressure monitoring point, which act on the control valve, to adjust the pressure in the crank chamber.

3. The air conditioning apparatus as set forth in claim 2, wherein the control valve includes:

a valve body;

a pressure sensitive chamber; and a pressure sensitive member, which divides the pressure sensitive chamber to a first pressure chamber and a second pressure chamber, wherein the pressure at the first pressure monitoring point is introduced to the first pressure chamber through the first pressure introducing passage, the pressure at the second pressure monitoring point is introduced to the second pressure chamber through the second pressure introducing passage, and the pressure sensitive member moves the valve body in accordance with the difference between the pressure in the first pressure chamber and the pressure in the second pressure chamber, which act on the pressure sensitive member, such that the pressure difference between the first and second pressure monitoring points seeks the target value.

4. The air conditioning apparatus as set forth in claim 2, wherein the control valve includes:

a valve body;

a pressure sensitive chamber; and a pressure sensitive member, which divides the pressure sensitive chamber to a first pressure chamber and a second pressure chamber, wherein the pressure at the first pressure monitoring point is introduced to the first pressure chamber through the first pressure introducing passage, the pressure at the second pressure monitoring point is introduced to the second pressure chamber through the second pressure introducing passage, and the pressure sensitive member moves the valve body in accordance with the difference between the pressure in the first pressure chamber and the pressure in the second pressure chamber, which act on the pressure sensitive member, such that the compressor displacement is varied to cancel a change of the pressure difference between the first and second pressure chambers.

5. The air conditioning apparatus as set forth in claim 3, wherein the altering device is an electromagnetic actuator located in the control valve, the electromagnetic actuator urges the valve body with an urging force corresponding to the magnitude of electric current supplied to the actuator, and the magnitude of the electric current supplied to the electromagnetic actuator reflects the target value.

6. The air conditioning apparatus as set forth in claim 5, further comprising:

an external information obtaining device for obtaining the external information that reflects cooling performance required for the refrigerant circuit; and a controller, which determines the target value depending on the external information obtained by the external information obtaining device and supplies the electric current corresponding to the determined target value to the electromagnetic actuator.

7. The air conditioning apparatus as set forth in claim 1, wherein a section of the refrigerant circuit between the first and second pressure monitoring points functions as the adjusting line.

8. The air conditioning apparatus as set forth in claim 1, wherein the adjusting line is parallel with a section of the refrigerant circuit between the first and second pressure monitoring points.

9. The air conditioning apparatus as set forth in claim 3, wherein the adjusting line is located in the control valve to connect the first pressure chamber to the second pressure chamber.

10. The air conditioning apparatus as set forth in claim 9, wherein the adjusting line is formed in the pressure sensitive member.

11. The air conditioning apparatus as set forth in claim 10, wherein the adjusting valve is located in the pressure sensitive member.

12. The air conditioning apparatus as set forth in claim 1, wherein the adjusting valve is operated in accordance with a refrigerant flow rate in the refrigerant circuit or a physical quantity that is varied in correlation with the refrigerant flow rate.

13. The air conditioning apparatus as set forth in claim 12, wherein the adjusting valve is operated in accordance with the difference between the pressure acting on an upstream side of the adjusting valve and the pressure acting on a downstream side of the adjusting valve.

14. The air conditioning apparatus as set forth in claim 12, wherein the adjusting valve increases the opening size of the adjusting line as the refrigerant flow rate in the refrigerant circuit increases.

15. An air conditioning apparatus provided with a refrigerant circuit including a variable displacement compressor, comprising:

a displacement control mechanism, which controls the displacement of the compressor in relation to a pressure difference between a first pressure monitoring point and a second pressure monitoring point in the refrigerant circuit such that the pressure difference seeks a predetermined target value, wherein the second pressure monitoring point is located downstream of the first pressure monitoring point, and the displacement control mechanism has an altering device for altering the target value; and a variable throttle valve, which is located in a section of the refrigerant circuit between the first pressure monitoring point and the second pressure monitoring point, wherein the variable throttle valve adjusts the restriction amount of the refrigerant in relation to the refrigerant flow rate in the refrigerant circuit.

16. The air conditioning apparatus as set forth in claim 15, wherein the variable throttle valve is operated in accordance with the difference between the pressure acting on an upstream side of the throttle valve and the pressure acting on a downstream side of the throttle valve.

17. The air conditioning apparatus as set forth in claim 15, wherein the variable throttle valve reduces the restriction amount of the refrigerant as the refrigerant flow rate in the refrigerant circuit increases.

18. A displacement control valve for controlling the displacement of a variable displacement compressor incorporated in a refrigerant circuit of an air conditioning apparatus, comprising:

a valve housing;

a valve body, which is accommodated in the valve housing;

a pressure sensitive chamber, which is formed in the valve housing;

a pressure sensitive member, which divides the pressure sensitive chamber to a first pressure chamber and a second pressure chamber, wherein the pressure at a first pressure monitoring point in the refrigerant circuit is introduced to the first pressure chamber, the pressure at a second pressure monitoring point in the refrigerant circuit is introduced to the second pressure chamber, and the pressure sensitive member moves the valve body in accordance with the pressure difference between the first pressure chamber and the second pressure chamber, thereby controlling the displacement of the compressor such that the pressure difference between the first and second pressure monitoring points seeks a predetermined target value;

an altering device for altering the target value, wherein the altering device urges the valve body with a force corresponding to the target value;

an adjusting line, which is formed in the pressure sensitive member to connect the first pressure chamber to the second pressure chamber; and an adjusting valve, which adjusts the opening size of the adjusting line.

19. The displacement control valve as set forth in claim 18, wherein the adjusting valve is operated in accordance with a refrigerant flow rate in the refrigerant circuit or a physical quantity that is varied in correlation with the refrigerant flow rate.

20. The displacement control valve as set forth in claim 19, wherein the adjusting valve is operated in accordance with the difference between the pressure in the first pressure chamber and the pressure in the second pressure chamber.

21. The displacement control valve as set forth in claim 19, wherein the adjusting valve increases the opening size of the adjusting line as the refrigerant flow rate in the refrigerant circuit increases.

* * * * *